US012071703B2

(12) United States Patent
Jung et al.

(10) Patent No.: US 12,071,703 B2
(45) Date of Patent: Aug. 27, 2024

(54) ELECTROPLATING SOLUTION FOR INDIUM-BISMUTH ALLOY FOR LOW-TEMPERATURE SOLDER WITH IMPROVED BISMUTH SUBSTITUTION PREVENTION PERFORMANCE

(71) Applicant: HOJIN PLATECH CO., LTD., Ansan-si (KR)

(72) Inventors: Woon Suk Jung, Ansan-si (KR); Jong Uk Kim, Gunpo-si (KR)

(73) Assignee: HOJIN PLATECH CO., LTD., Ansan-si (KR)

( * ) Notice: Subject to any disclaimer, the term of this patent is extended or adjusted under 35 U.S.C. 154(b) by 0 days.

(21) Appl. No.: 18/517,216

(22) Filed: Nov. 22, 2023

(65) Prior Publication Data

US 2024/0167183 A1 May 23, 2024

(30) Foreign Application Priority Data

Nov. 23, 2022 (KR) ..... 10-2022-0158670

(51) Int. Cl.
*C25D 3/56* (2006.01)

(52) U.S. Cl.
CPC ..... *C25D 3/56* (2013.01)

(58) Field of Classification Search
CPC ..... C25D 3/56
See application file for complete search history.

(56) References Cited

U.S. PATENT DOCUMENTS

| | | | | |
|---|---|---|---|---|
| 10,947,424 | B2 * | 3/2021 | Vella | C09J 163/00 |
| 2011/0103022 | A1 * | 5/2011 | Szocs | H01L 23/3735 205/261 |
| 2018/0355500 | A1 * | 12/2018 | Sperling | C25D 5/605 |

FOREIGN PATENT DOCUMENTS

| | | | |
|---|---|---|---|
| JP | 2006-117980 | A | 5/2006 |
| KR | 10-2008-0090343 | A | 10/2008 |
| KR | 10-2016-0121296 | A | 10/2016 |
| KR | 10-2021-0148368 | A | 12/2021 |
| KR | 10-2023-0097533 | A | 7/2023 |

OTHER PUBLICATIONS

Notice of Allowance dated Nov. 23, 2023 in Korean Application No. 10-2022-0158670.
Office Action dated Jan. 2, 2023 in Korean Application No. 10-2022-0158670.
Office Action dated Sep. 6, 2023 in Korean Application No. 10-2022-0158670.

* cited by examiner

*Primary Examiner* — Ciel P Contreras
(74) *Attorney, Agent, or Firm* — Saliwanchik, Lloyd & Eisenschenk

(57) ABSTRACT

Provided is an electroplating solution for an indium-bismuth alloy for low-temperature solder, which has a melting point of approximately 140° C. or lower and is capable of inhibiting the displacement of bismuth when manufacturing solder wires. The electroplating solution for an indium-bismuth alloy includes a supplying source of indium ions, a supplying source of bismuth ions, a combination of polyoxyethylene lauryl amine ether and ethoxylated acetylenic diol as a surfactant, carboxylic acid or carboxylate as a complexing agent, and a mercaptotetrazole compound as an auxiliary complexing agent.

5 Claims, 1 Drawing Sheet

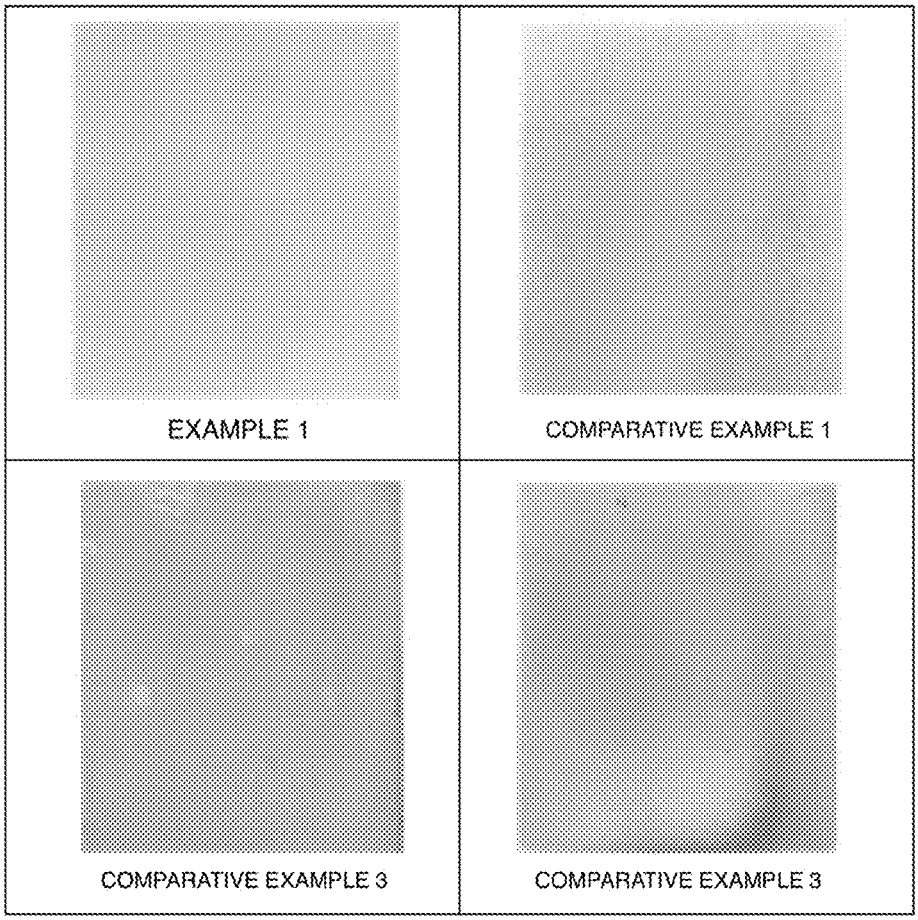
EXAMPLE 1
COMPARATIVE EXAMPLE 1
COMPARATIVE EXAMPLE 3
COMPARATIVE EXAMPLE 3

ELECTROPLATING SOLUTION FOR INDIUM-BISMUTH ALLOY FOR LOW-TEMPERATURE SOLDER WITH IMPROVED BISMUTH SUBSTITUTION PREVENTION PERFORMANCE

CROSS-REFERENCE TO RELATED APPLICATION

This application claims priority to Korean Patent Application No. 10-2022-0158670 filed on Nov. 23, 2022 and all the benefits accruing therefrom under 35 U.S.C. § 119, the contents of which are incorporated by reference in their entirety.

BACKGROUND

The present disclosure relates to an electroplating solution for an indium-bismuth alloy, and more particularly, to an electroplating solution for manufacturing an indium-bismuth alloy having a melting point of approximately 140° C. or lower and improved bismuth displacement prevention performance when applying a solder material using a plating method such as a solder-wire or flip-chip process in the fields of solar cell modules, semiconductor devices, and electronic components.

Solar power generation is a power generation method that directly converts light energy from the sun into electrical energy, which can be used in real life. Recently, as the depletion of existing energy sources such as petroleum and coal is predicted, interest in alternative energy sources to replace the existing energy sources has increased, and accordingly, solar cells that generate electrical energy from solar energy are attracting attention.

Since the voltage and current generated by a solar cell are very small, in order to obtain a desired output, several solar cells are connected in series or parallel to manufacture and use a waterproof-type solar cell module in the form of a panel, and interconnectors are used to electrically connect solar cells in solar cell modules.

In the manufacturing of such an interconnector, a melting or plating method has been typically used. That is, in order to manufacture an interconnector, a copper wire or ribbon is passed through a molten solder to form a solder. Recently, there has been a growing demand for lead-free solders, which exclude lead (Pb) from typical flexible solders, for environmental reasons.

In addition, when a solder is bonded to a substrate or a circuit, the temperature should be raised to the melting point of the solder or higher (at least approximately 20° C.), and the higher the melting point, the more deteriorated the surrounding circuit, so that research and development of solders with a low melting point is urgently needed. For example, in order to use the bonding temperature of around 160° C., it is necessary to develop a low-temperature solder with a melting point of approximately 140° C. or lower. A Sn—Pb alloy, which is a typical leaded solder, has a melting point of approximately 183° C., and a Sn—Ag—Cu alloy, which is a lead-free solder, has a melting point of approximately 216° C. to approximately 225° C., it is not possible to have a bonding temperature lower than 160° C. A Sn—Bi alloy can have a melting point of 140° C. or lower, but has a very narrow metal concentration range for a low melting point (e.g., Sn 42 wt % and Bi 58 wt %), and thus, has a problem of no mass productivity when manufactured by plating. In addition, a Sn—Bi alloy can also have a melting point of 140° C. or lower, but has a very narrow metal concentration range for a low melting point (e.g., Sn 42 wt % and Bi 58 wt %), and thus, has a problem of no mass productivity when manufactured by plating.

In addition, bismuth (Bi) has properties of being easily substituted with a metal material such as Cu, Ni, and Fe, and precipitated, which acts as a factor that inhibits plating properties, so that it is necessary to suppress the displacement of bismuth as much as possible during plating.

SUMMARY

The present disclosure provides an electroplating solution for an indium-bismuth alloy for a low-temperature solder, wherein the electroplating solution has a melting point of approximately 140° C. or lower and is capable of inhibiting the displacement of bismuth when applying a solder material using a plating method in various fields of solar cell modules, semiconductor devices, and electronic components.

Tasks to be solved by the present disclosure are not limited to the above-mentioned tasks, and other tasks not mentioned will be clearly understood by those skilled in the art to which the present disclosure pertains from the following description.

In accordance with an exemplary embodiment of the present invention, an electroplating solution for an indium-bismuth alloy, which is an electroplating solution for an indium-bismuth alloy for a low-temperature solder, includes a supplying source of indium ions, a supplying source of indium ions, an antioxidant, a combination of polyoxyethylene lauryl amine ether and ethoxylated acetylenic diol as a surfactant, carboxylic acid or carboxylate as a complexing agent, and a mercaptotetrazole compound as an auxiliary complexing agent.

The weight ratio of polyoxyethylene lauryl amine ether and ethoxylated acetylenic diol constituting the surfactant may be approximately 50:1 to approximately 100:1.

The surfactant may include approximately 0.5 g/L to approximately 6 g/L of polyoxyethylene lauryl amine ether and approximately 0.01 g/L to approximately 0.2 g/L of ethoxylated acetylenic diol.

The use pH range of the electroplating solution may be approximately 2.5 pH to approximately 3.5 pH.

The complexing agent may include approximately 150 g/L to approximately 250 g/L of citric acid. The auxiliary complexing agent may include approximately 0.5 g/L to approximately 10 g/L of 1-(2-diethylaminoethyl)-5-mercapto-1,2,3,4-tetrazole.

The electroplating solution may further include caustic soda as a pH control agent.

An indium-bismuth alloy manufactured using the electroplating solution may be composed of approximately 4090 wt % of indium and approximately 10 wt % to approximately 60 wt % of bismuth, and may have a low melting point of approximately 140° C. or lower.

The supplying source of indium ions may be indium methanesulfonic acid, and the supplying source of bismuth ions may be bismuth methanesulfonic acid.

Other specific details of the embodiment are included in the detailed description and drawings.

BRIEF DESCRIPTION OF THE DRAWINGS

Exemplary embodiments can be understood in more detail from the following description taken in conjunction with the accompanying drawings, in which:

FIG. 1 shows photographs of the appearances of plated films in accordance with changes in a surfactant and an auxiliary complexing agent in an electroplating solution for an indium-bismuth alloy.

DETAILED DESCRIPTION OF EMBODIMENTS

Advantages and features of the present invention, and implementation methods thereof will be clarified through following embodiments described with reference to the accompanying drawings. The present invention may, however, be embodied in different forms and should not be construed as limited to the embodiments set forth herein. Rather, these embodiments are provided so that this disclosure will be thorough and complete, and will fully convey the scope of the inventive concept to those skilled in the art to which the inventive concept pertains. The inventive concept will only be defined by the appended claims.

An electroplating solution of the present invention relates to a plating solution for an indium-bismuth alloy for a low-temperature solder manufactured by plating in solar cell modules, semiconductor devices, electronic components, etc., or a plating solution for manufacturing an indium-bismuth alloy having a low melting point of approximately 140° C. or lower, and is characterized by using a surfactant (a combination of polyoxyethylene lauryl amine ether and ethoxylated acetylenic diol) and an auxiliary complexing agent (a mercaptotetrazole compound), thereby having improved bismuth displacement prevention performance during plating, resulting in having a wide use pH range (approximately 2.5 pH to approximately 3.5 pH). The electroplating solution of the present invention includes metal ions, an antioxidant, a surfactant, a complexing agent, and an auxiliary complexing agent. The metal ions are composed of indium (In) ions and bismuth (Bi) ions. Furthermore, the electroplating solution for an indium-bismuth alloy of the present invention may further include a pH control agent.

Indium methanesulfonic acid may be used as a supplying source of the indium (In) ions. The concentration of the indium ions in the plating solution may be approximately 10 g/L to approximately 60 g/L, preferably approximately 20 g/L to approximately 30 g/L. When the concentration of the indium ions is less than approximately 10 g/L, the plating rate may decrease due to a decrease in current efficiency or plated film structures and solder wire shapes may not be uniform, and when the concentration of the indium ions is greater than approximately 60 g/L, the bismuth content in the plated film may be lowered, resulting in changes in plating particles.

In the present invention, methanesulfonic acid may be used as a conductive salt or an electrolyte. It is preferable that the concentration of the conductive salt is maintained at approximately 10 g/L to approximately 30 g/L, and the concentration of an electrolyte may be naturally maintained by the supplying source of indium ions (indium methanesulfonic acid) without the need to add methanesulfonic acid separately.

Bismuth methanesulfonic acid may be used as the supplying source of bismuth (Bi) ions. It is preferable that the concentration of the bismuth ions in the plating solution is maintained at approximately 0.5 g/L to approximately 2 g/L, in which case an alloy with a bismuth content of approximately 10 wt % to approximately 60 wt % may be obtained. The concentration of an electrolyte may be naturally maintained by the supplying source of bismuth ions (bismuth methanesulfonic acid) without the need to add methanesulfonic acid as the conductive salt separately.

The antioxidant is used for metal oxidation prevention and plating stability, and may be at least one selected from the group consisting of catechols, hydroquinones, and resocinols. Preferably, methylhydroquinone or hydroquinone sulfonate may be used. The concentration of the antioxidant may be approximately 0.1 g/L to approximately 5 g/L.

The complexing agent serves to ensure solution stability and inhibit bismuth displacement within a use pH range, and carboxylic acid or carboxylate may be used. Preferably, malic acid, citric acid, malonic acid, tartaric acid, or the like may be used. More preferably, citric acid or citrate may be used. The concentration of the complexing agent is preferably maintained at approximately 150 g/L to approximately 250 g/L, and metal ion stability may be ensured within this range. If the concentration of the complexing agent is less than 150 g/L, a phenomenon occurs in which the solution becomes cloudy and indium is precipitated in the use pH range.

The auxiliary complexing agent serves to enhance the bismuth displacement prevention performance, and a mercaptotetrazole compound and the like may be used. The concentration of the mercaptotetrazole compound may be approximately 0.5 g/L to 10 g/L. If the concentration of the mercaptotetrazole compound is less than 0.5 g/L, the bismuth displacement prevention performance is not improved, and if the concentration of the mercaptotetrazole compound is greater than 10 g/L, a phenomenon occurs in which the deviation of the bismuth content in the plated film increases. Examples of the mercaptotetrazole compound include 1-(2-diethylaminoethyl)-5-mercapto-1,2,3,4-tetrazole, 1-(3-ureidophenyl)-5-mercaptotetrazole, 1-((3-N-ethyloxalamido)phenyl)-5-mercaptotetrazole, 1-(4-acetamidophenyl)-5-mercapto-tetrazole, 1-(4-carboxyphenyl)-5-mercaptotetrazole, and the like. Preferably, as the mercaptotetrazole compound, 1-(2-diethylaminoethyl)-5-mercapto-1,2,3,4-tetrazole or the like may be used.

When the complexing agent is used alone without an auxiliary complexing agent, it is possible to ensure solution stability by inhibiting the displacement of bismuth and maintaining the solution clear in the range of approximately 3 pH to approximately 3.5 pH. Furthermore, when an auxiliary complexing agent is used in addition to the complexing agent, the use pH range is further increased, so that it is possible to ensure solution stability by inhibiting the displacement of bismuth and maintaining the solution clear in the range of approximately 2.5 pH to approximately 3.5 pH.

As the surfactant, a cationic surfactant, an anionic surfactants, an amphoteric surfactant, or a non-ionic surfactant may be used. Preferably, a non-ionic surfactant may be used to obtain solder wires in a uniform shape and uniform plated films. Preferably, a polyoxyethyleneamine-based surfactant may be used. For example, polyoxyethylene stearyl amine ether, polyoxyethylene lauryl amine ether, polyoxyethylene tallow amine ether, or the like may be used. More preferably, a combination of polyoxyethylene lauryl amine ether and ethoxylated acetylenic diol may be used as the surfactant. If only the polyoxyethylene lauryl amine ether is used as the surfactant, a bright and uniform plating appearance may be obtained, but a hydrogen gas generated during plating does not fall off a plated surface, resulting in forming pits on the plated surface, and furthermore, dark stains are likely to be formed on the plated surface due to bismuth displacement. However, if ethoxylated acetylenic diol is added to the polyoxyethylene lauryl amine ether, plating properties may be improved by inhibiting the pit formation on a plated surface and the bismuth displacement. Polyoxyethylene lauryl amine ether is preferably used in the range of approximately 0.5 g/L to approximately 6 g/L, and ethoxylated acetylenic diol is preferably used in the range of approximately 0.01 g/L to approximately 0.2 g/L. If the concentration of polyoxyethylene lauryl amine ether is less than approximately 0.5 g/L, or the concentration of ethoxylated acetylenic diol is less than approximately 0.01 g/L, the performance of the surfactant decreases, resulting in poor plating properties. If the concentration of polyoxyethylene lauryl amine ether is greater than approximately 6 g/L, or the concentration of ethoxylated acetylenic diol is greater than approximately 0.2 g/L, the amount of indium precipitation decreases, so that the plating rate also decreases, and furthermore, the alloy ratio changes, so that it is difficult to obtain an alloy having a low melting point of approximately 140° C. or lower. When the weight ratio of polyoxyethylene lauryl amine ether and ethoxylated acetylenic diol is approximately 50:1 to approximately 100:1, optimal plating properties may be obtained.

An indium-bismuth alloy manufactured using the electroplating solution of the present invention is composed of approximately 40 wt % to approximately 90 wt % of indium and approximately 10 wt % to approximately 60 wt % of bismuth, and has a low melting point of approximately 140° C. or lower in the above alloy ratio. In order to obtain the desired alloy ratio as described above, required components and the concentrations thereof in a plating solution should be specified, and plating conditions such as the pH, temperature, and current density should be maintained within predetermined ranges.

Particularly, in the present invention, the pH of a plating solution is a factor that significantly affects the alloy ratio and plating appearance, and the electroplating solution of the present invention preferably has a pH of approximately 2.5 to approximately 3.5. If the pH of the plating solution is lower than approximately 2.5, the bismuth displacement occurs during plating, causing a plated surface to appear non-uniform, and if the pH of the plating solution is higher than approximately 3.5, the bismuth content increases excessively, making it impossible to obtain the desired alloy ratio. As the pH control agent of the plating solution, methanesulfonic acid may be used to lower the pH, and caustic soda may be used to increase the pH.

The temperature of the plating solution may be approximately 25° C. to approximately 60° C., preferably approximately 25° C. to approximately 35° C.

In forming a solder wire using an electroplating solution for an indium-bismuth alloy, steps of preparing the electroplating solution for an indium-bismuth alloy, stirring the plating solution, placing a material to be plated into the electroplating solution, and performing plating by applying a current with a current density of approximately 1 A/dm$^2$ to approximately 5 A/dm$^2$ are included. Preferably, the current may be applied with a current density of approximately 1 A/dm$^2$ to approximately 3 A/dm$^2$. If the current density is less than approximately 1 A/dm$^2$, plating particles become large, so that the solder wire shapes become non-uniform, and if the current density is greater than approximately 5 A/dm$^2$, the plating structure becomes rough, so that the plating efficiency decreases.

Hereinafter, the configuration of the present invention and the effects thereof will be described in detail with reference to examples and comparative examples. The examples are intended to describe the present invention in more detail, and the scope of rights of the present invention are not limited by the examples.

EXAMPLES

Table 1 to Table 3 below show the components and contents of electroplating solutions for an indium-bismuth alloy according to embodiments of the present invention, and the plating conditions (current density, temperature, pH) applied during electroplating. A solder wire manufactured by performing a typical plating process (degreasing, pickling, plating, neutralizing, and drying) using an electroplating solution for an indium-bismuth alloy was observed. The plating was performed for 5 minutes.

TABLE 1

| | Example 1 | Example 2 | Example 3 | Example 4 |
|---|---|---|---|---|
| Indium ions | 25 g/L | 25 g/L | 25 g/L | 25 g/L |
| Antioxidant | Methyl hydroquinone 1 g/L | Methyl hydroquinone 1 g/L | Methyl hydroquinone 1 g/L | Methyl hydroquinone 1 g/L |
| Surfactant | Polyoxyethylene lauryl amine ether 5 g/L Ethoxylated acetylenic diol 0.05 g/L | Polyoxyethylene lauryl amine ether 3 g/L Ethoxylated acetylenic diol 0.05 g/L | Polyoxyethylene lauryl amine ether 2 g/L Ethoxylated acetylenic diol 0.02 g/L | Polyoxyethylene lauryl amine ether 5 g/L Ethoxylated acetylenic diol 0.05 g/L |
| Bismuth ion | 1.5 g/L | 1.5 g/L | 1.5 g/L | 1.0 g/L |
| Complexing agent | Citric acid 200 g/L | Citric acid 200 g/L | Citric acid 200 g/L | Citric acid 200 g/L |
| Auxiliary complexing agent | Diethylaminoethyl mercapto tetrazole 2 g/L | Diethylaminomethyl mercapto tetrazole 2 g/L | Diethylaminomethyl mercapto tetrazole 2 g/L | Diethylaminomethyl mercapto tetrazole 4 g/L |
| Current density | 1.5 A/dm$^2$ | 1.5 A/dm$^2$ | 1.5 A/dm$^2$ | 1.5 A/dm$^2$ |
| Temperature | 30° C. | 30° C. | 30° C. | 30° C. |
| pH | 3.0 | 3.0 | 3.0 | 3.0 |

TABLE 2

| | Example 5 | Example 6 | Example 7 | Example 8 |
|---|---|---|---|---|
| Indium ions | 25 g/L | 25 g/L | 25 g/L | 25 g/L |
| Antioxidant | Methyl hydroquinone 1 g/L | Methyl hydroquinone 1 g/L | Methyl hydroquinone 1 g/L | Methyl hydroquinone 1 g/L |
| Surfactant | Polyoxyethylene lauryl amine ether 5 g/L Ethoxylated acetylenic diol 0.05 g/L | Polyoxyethylene lauryl amine ether 5 g/L Ethoxylated acetylenic diol 0.05 g/L | Polyoxyethylene lauryl amine ether 5 g/L Ethoxylated acetylenic diol 0.05 g/L | Polyoxyethylene lauryl amine ether 5 g/L Ethoxylated acetylenic diol 0.05 g/L |
| Bismuth ion | 2.0 g/L | 1.5 g/L | 1.5 g/L | 1.5 g/L |
| Complexing agent | Citric acid 200 g/L | Citric acid 200 g/L | Citric acid 200 g/L | Citric acid 200 g/L |
| Auxiliary complexing agent | Diethylaminoethyl mercapto tetrazole 4 g/L | Diethylaminoethyl mercapto tetrazole 2 g/L | Diethylaminoethyl mercapto tetrazole 2 g/L | Diethylaminoethyl mercapto tetrazole 2 g/L |
| Current density | 1.5 A/dm$^2$ | 1.5 A/dm$^2$ | 1.5 A/dm$^2$ | 1.0 A/dm$^2$ |
| Temperature | 30° C. | 30° C. | 30° C. | 30° C. |
| pH | 3.0 | 2.5 | 3.5 | 3.0 |

TABLE 3

| | Example 9 | Example 10 | Example 11 |
|---|---|---|---|
| Indium ions | 25 g/L | 25 g/L | 25 g/L |
| Antioxidant | Methyl hydroquinone 1 g/L | Methyl hydroquinone 1 g/L | Methyl hydroquinone 1 g/L |
| Surfactant | Polyoxyethylene lauryl amine ether 5 g/L Ethoxylated acetylenic diol 0.05 g/L | Polyoxyethylene lauryl amine ether 5 g/L Ethoxylated acetylenic diol 0.05 g/L | Polyoxyethylene lauryl amine ether 5 g/L Ethoxylated acetylenic diol 0.05 g/L |
| Bismuth ion | 1.5 g/L | 1.5 g/L | 1.5 g/L |
| Complexing agent | Citric acid 200 g/L | Citric acid 200 g/L | Citric acid 200 g/L |
| Auxiliary complexing agent | Diethylaminoethyl mercapto tetrazole 2 g/L | Diethylaminoethyl mercapto tetrazole 4 g/L | Diethylaminoethyl mercapto tetrazole 4 g/L |
| Current density | 3.0 A/dm$^2$ | 1.5 A/dm$^2$ | 1.5 A/dm$^2$ |
| Temperature | 30° C. | 20° C. | 40° C. |
| pH | 3.0 | 3.0 | 3.0 |

Table 4 and Table 5 below show the plating appearance state and alloy ratio of each Example after plating.

TABLE 4

| | Example 1 | Example 2 | Example 3 | Example 4 | Example 5 |
|---|---|---|---|---|---|
| Plating appearance | Good | Good | Good | Good | Good |
| In content (wt %) | 74.46 | 75.21 | 73.22 | 80.36 | 64.22 |
| Bi content (wt %) | 25.54 | 24.73 | 26.78 | 19.65 | 35.67 |

TABLE 5

| | Example 6 | Example 7 | Example 8 | Example 9 | Example 10 | Example 11 |
|---|---|---|---|---|---|---|
| Plating appearance | Good | Good | Good | Good | Good | Good |
| In content (wt %) | 78.64 | 52.44 | 69.60 | 78.61 | 74.39 | 73.17 |
| Bi content (wt %) | 21.36 | 47.56 | 30.40 | 21.39 | 25.62 | 26.83 |

In Examples 1 to 3, a plating process was performed by changing the concentration ratio of polyoxyethylene lauryl amine ether and ethoxylated acetylenic diol, and as shown in Table 4, the plating appearance was confirmed to be good in all Examples, and similar results were obtained for the alloy ratio.

In Examples 4 and 5, a plating process was performed by changing the bismuth concentration, and as shown in Table 4, the plating appearance was confirmed to be good, and the bismuth content was approximately 19.65 wt % to approximately 35.67 wt %, varying by approximately 5 wt % to approximately 6 wt % up and down.

In Examples 6 to 7, a plating process was performed by lowering the pH of the plating solution to 2.5 and increasing the same to 3.5, respectively, and as shown in Table 5, the plating appearance was confirmed to be good, but when the pH was lowered to 2.5 for the same concentration of bismuth, the bismuth content was also lowered to 21.36 wt %, and when the pH was increased to 3.5, the bismuth content also increased significantly to 47.56 wt %. Therefore, it has been confirmed that the bismuth content in the alloy was more affected by changes in pH than by changes in bismuth concentration in the plating solution.

In Examples 8 and 9, a plating process was performed by changing the current density, and as shown in Table 5, the plating appearance was confirmed to be good in both Examples. In the case of Example 9, it has been confirmed that the plating particles were relatively large and coarse in the high-current region at the outer end portion, and it has been confirmed that the bismuth content tended to slightly decrease as the current density increased.

In Examples 10 to 11, a plating process was performed by changing the temperature, and as shown in Table 5, the plating appearance was confirmed to be good, and changes in alloy ratio due to the temperature change were confirmed to be not significant.

The plating solution state in all Examples was good, and no precipitate, such as indium or bismuth, was formed.

Comparative Examples

Table 6 below shows the components and contents of electroplating solutions for an indium-bismuth alloy used as Comparative Examples, and the plating conditions (current density, temperature, pH) applied during electroplating.

TABLE 6

| | Comparative Example 1 | Comparative Example 2 | Comparative Example 3 | Comparative Example 4 | Comparative Example 5 |
|---|---|---|---|---|---|
| Indium ions | 25 g/L | 25 g/L | 25 g/L | 25 g/L | 25 g/L |
| Antioxidant | Methyl hydroquinone 1 g/L | Methyl hydroquinone 1 g/L | Methyl hydroquinone 1 g/L | Methyl hydroquinone 1 g/L | Methyl hydroquinone 1 g/L |
| Surfactant | Polyoxyethylene lauryl amine ether 5 g/L | Ethoxylated acetylenic diol 0.05 g/L | Polyoxyethylene lauryl amine ether 5 g/L Ethoxylated acetylenic diol 0.05 g/L | Polyoxyethylene lauryl amine ether 5 g/L Ethoxylated acetylenic diol 0.05 g/L | Polyoxyethylene lauryl amine ether 5 g/L Ethoxylated acetylenic diol 0.05 g/L |
| Bismuth ion | 1.5 g/L | 1.5 g/L | 1.5 g/L | 1.5 g/L | 1.0 g/L |
| Complexing agent | Citric acid 200 g/L | Citric acid 200 g/L | Citric acid 200 g/L | Citric acid 200 g/L | Citric acid 100 g/L |
| Auxiliary complexing agent | Diethylaminoethyl mercapto tetrazole 2 g/L | Diethylaminoethyl mercapto tetrazole 2 g/L | | Diethylaminoethyl mercapto tetrazole 2 g/L | Diethylaminoethyl mercapto tetrazole 2 g/L |
| Current density | 1.5 A/dm$^2$ | 1.5 A/dm$^2$ | 1.5 A/dm$^2$ | 1.5 A/dm$^2$ | 1.5 A/dm$^2$ |
| Temperature | 30° C. | 30° C. | 30° C. | 30° C. | 30° C. |
| pH | 3.0 | 3.0 | 2.5 | 2.0 | 3.0 |

Table 7 below show the plating appearance state after plating and alloy ratio of each Comparative Example.

TABLE 7

| | Comparative Example 1 | Comparative Example 2 | Comparative Example 3 | Comparative Example 4 | Comparative Example 5 |
|---|---|---|---|---|---|
| Plating appearance | Pit occurrence Bismuth displacement | Dark appearance | Bismuth displacement appearance stain | Bismuth displacement appearance stain | Bismuth displacement appearance stain |
| In content (wt %) | 82.34 | 32.14 | 72.35 | 72.28 | 82.34 |
| Bi content (wt %) | 17.66 | 67.85 | 27.65 | 27.72 | 17.66 |

FIG. 1 shows photographs of the appearances of plated films in accordance with changes in a surfactant and an auxiliary complexing agent in an electroplating solution for an indium-bismuth alloy.

Comparative Example 1 is a case in which only polyoxyethylene lauryl amine ether was used as a surfactant and ethoxylated acetylenic diol was not used, and as shown in FIG. 1 and Table 7, pits were formed on the plated surface and bismuth displacement occurred. The bismuth content in the alloy was confirmed to have a low value compared to Examples of the present invention.

Comparative Example 2 is a case in which only ethoxylated acetylenic diol was used as a surfactant and polyoxyethylene lauryl amine ether was not used, and as shown in FIG. 1 and Table 7, although bismuth displacement or pit formation rarely occurred, a dark plating appearance was confirmed due to an excessive increase in the bismuth content in the alloy.

Comparative Example 3 is a case in which the pH was maintained at the lower limit within the use range (approximately 2.5 pH to approximately 3.5 pH) and no auxiliary complexing agent (a mercaptotetrazole compound) was used, and as shown in FIG. 1 and Table 7, a dark stain appeared on the plated surface due to bismuth displacement. In other words, it has been confirmed that even if a combination of polyoxyethylene lauryl amine ether and ethoxylated acetylenic diol is used as a surfactant, bismuth displacement occurs if the auxiliary complexing agent (a mercaptotetrazole compound) is not used when the pH is 3 or lower.

Comparative Example 4 is a case in which the pH was maintained at 2, which is lower than the use range (approximately 2.5 pH to approximately 3.5 pH), and as shown in Table 7, a dark stain appeared on the plated surface due to bismuth displacement. It has been confirmed that even if a combination of polyoxyethylene lauryl amine ether and ethoxylated acetylenic diol is used as a surfactant, bismuth displacement occurs when the pH is lower than 2.5.

Comparative Example 5 is a case in which the concentration of citric acid, which is a complexing agent, was as low as approximately 100 g/L, and as shown in Table 7, the plating appearance was uneven, and bismuth displacement occurred. In addition, the plating solution was cloudy and indium precipitation was confirmed when left to stand.

As described above, an electroplating solution for an indium-bismuth alloy according to the present invention has the following excellent effects.

First, when a solder is manufactured using an electroplating solution for an indium-bismuth alloy of the present invention, the melting point of the solder is approximately 140° C. or lower, so that the bonding temperature of the solder may be maintained at approximately 160° C. or lower to inhibit the deterioration of a surrounding circuit. Furthermore, in order to have achieve such a low melting point, bismuth in an alloy needs to be in the range of approximately 10 wt % to approximately 60 wt %, so that even if the solder is manufactured by plating, there is sufficient mass productivity.

Second, the electroplating solution for an indium-bismuth alloy of the present invention uses a mixture of polyoxyethylene lauryl amine ether and ethoxylated acetylenic diol as a surfactant, it is possible to obtain a bright and uniform coating film by suppressing the displacement of bismuth and suppressing the formation of pits on a plated surface.

Third, in the case of the electroplating solution for an indium-bismuth alloy of the present invention, methanesulfonic acid is used as a conductive salt required for plating, but unlike other plating solutions, the required concentration of a conductive salt in the plating solution of the present invention is as low as approximately 10 g/L to approximately 30 g/L, so that the concentration of an electrolyte may be naturally maintained by a supplying source of indium ions (indium methanesulfonic acid) and a supplying source of bismuth ions (bismuth methanesulfonic acid) without the need to add methanesulfonic acid separately.

Fourth, the electroplating solution for an indium-bismuth alloy of the present invention uses carboxylic acid or carboxylate as a complexing agent and a mercaptotetrazole compound as an auxiliary complexing agent. When the complexing agent is used alone without an auxiliary complexing agent, it is possible to ensure solution stability while inhibiting the displacement of bismuth in the range of approximately 3 pH to approximately 3.5 pH. Furthermore, when an auxiliary complexing agent is used in addition to the complexing agent, the use pH range is further increased, so that it is possible to ensure solution stability while inhibiting the displacement of bismuth in the range of approximately 2.5 pH to approximately 3.5 pH.

Although the present invention has been described with reference to the accompanying drawings, it will be understood by those having ordinary skill in the art to which the present invention pertains that various changes in form and details may be made therein without departing from the spirit and scope of the present invention. Therefore, it is to be understood that the above-described embodiments are exemplary and non-limiting in every aspect.

What is claimed is:

1. An electroplating solution for an indium-bismuth alloy for low-temperature solder, the electroplating solution comprising:

a supplying source of indium ions;

a supplying source of bismuth ions;

an antioxidant;

a combination of polyoxyethylene lauryl amine ether and ethoxylated acetylenic diol as a surfactant that suppresses bismuth displacement;

carboxylic acid or carboxylate as a complexing agent; and a mercaptotetrazole compound as an auxiliary complexing agent, wherein an alloy manufactured using the electroplating solution is an indium-bismuth binary alloy comprising 40 wt % to 90 wt % of indium and 10 wt % to 60 wt % of bismuth, and has a low melting point of 140° C. or lower.

2. The electroplating solution of claim 1, wherein the weight ratio of polyoxyethylene lauryl amine ether and ethoxylated acetylenic diol constituting the surfactant is 50:1 to 100:1.

3. The electroplating solution of claim 1, wherein the surfactant comprises 0.5 g/L to 6 g/L of polyoxyethylene lauryl amine ether and 0.01 g/L to 0.2 g/L of ethoxylated acetylenic diol.

4. The electroplating solution of claim 1, wherein the use pH range of the electroplating solution is 2.5 pH to 3.5 pH.

5. The electroplating solution of claim 1, wherein: the complexing agent comprises 150 g/L to 250 g/L of citric acid; and the auxiliary complexing agent comprises 0.5 g/L to 10 g/L of 1-(2-diethylaminoethyl)-5-mercapto-1,2,3,4-tetrazole.

* * * * *